US008662148B2

(12) United States Patent
Wand

(10) Patent No.: US 8,662,148 B2
(45) Date of Patent: Mar. 4, 2014

(54) HEAT EXCHANGER

(75) Inventor: Steven M. Wand, York, PA (US)

(73) Assignee: Alcoil, Inc., Jacobus, PA (US)

( * ) Notice: Subject to any disclaimer, the term of this patent is extended or adjusted under 35 U.S.C. 154(b) by 1078 days.

(21) Appl. No.: 12/691,920

(22) Filed: Jan. 22, 2010

(65) Prior Publication Data

US 2010/0186935 A1 Jul. 29, 2010

Related U.S. Application Data

(60) Provisional application No. 61/147,117, filed on Jan. 25, 2009.

(51) Int. Cl.

| | |
|---|---|
| ***F28D 1/06*** | (2006.01) |
| ***F28F 27/00*** | (2006.01) |
| ***F28D 1/02*** | (2006.01) |
| ***F28F 9/02*** | (2006.01) |

(52) U.S. Cl.
USPC ..... 165/132; 165/153; 165/174; 165/96

(58) Field of Classification Search
USPC ..... 165/152, 153, 174, 96, 164, 104.32, 165/917; 62/515, 527
See application file for complete search history.

(56) References Cited

U.S. PATENT DOCUMENTS

| | | | | |
|---|---|---|---|---|
| 4,177,859 | A * | 12/1979 | Gatti et al. | 165/134.1 |
| 4,422,502 | A * | 12/1983 | Villeval | 165/104.32 |
| 4,846,265 | A * | 7/1989 | Broglio | 165/104.32 |
| 4,998,580 | A | 3/1991 | Guntly et al. | |
| 5,141,048 | A * | 8/1992 | Sausner | 165/110 |

(Continued)

FOREIGN PATENT DOCUMENTS

| | | | |
|---|---|---|---|
| EP | 1219907 | A3 | 7/2005 |
| JP | 05026539 | A | 2/1993 |
| JP | 04139364 | A | 5/1995 |
| JP | 11211276 | A | 8/1999 |

OTHER PUBLICATIONS

Tushar Kulkarni et al., "Header Design Tradeoffs in Microchannel Evaporators", Applied Thermal Engineering, Jan. 1, 2004, pp. 759-776, vol. 24, Pergamon, Oxford, GB.

(Continued)

*Primary Examiner* — Allen Flanigan
*Assistant Examiner* — Jason Thompson
(74) *Attorney, Agent, or Firm* — McNees Wallace & Nurick LLC

(57) ABSTRACT

The invention is directed to a heat exchanger with optimal performance and a method of optimizing the performance of a heat exchanger. The heat exchanger has a first manifold, a second manifold and tubes extending therebetween. The tubes have at least one opening which extends through the entire length of the tubes. The method may include: governing the pressure drop in the heat exchanger by selecting different size openings or configurations of the tubes depending upon the type of refrigerant used and the properties thereof; optimizing the dimensions of the first manifold and second manifold, such that the ratio of manifold to tube size or manifold to tube opening cross sectional area yields low pressure drops and minimized the effects of pressure drop in the manifold and tube combination; and optimizing the ratio of the mass flow capacity of the first and second manifolds to the tubes flow capacity such that the first manifold has minimal or negligible mal-distribution effect when providing refrigerant to the tubes, thereby improving the overall performance of the heat exchanger.

11 Claims, 5 Drawing Sheets

(56) References Cited

U.S. PATENT DOCUMENTS

| | | | | |
|---|---|---|---|---|
| 5,193,613 | A | 3/1993 | Wallis | |
| 5,307,870 | A | 5/1994 | Kamiya et al. | |
| 5,346,000 | A * | 9/1994 | Schlitt | 165/104.26 |
| 5,372,188 | A | 12/1994 | Dudley et al. | |
| 6,062,303 | A | 5/2000 | Ahn et al. | |
| 6,223,556 | B1 | 5/2001 | De Keuster et al. | |
| 6,340,055 | B1 * | 1/2002 | Yamauchi et al. | 165/174 |
| 6,543,528 | B2 * | 4/2003 | Saito et al. | 165/153 |
| 7,527,089 | B2 * | 5/2009 | Gorbounov et al. | 165/174 |
| 2002/0066554 | A1 | 6/2002 | Oh et al. | |
| 2004/0256090 | A1 | 12/2004 | Katoh et al. | |
| 2005/0051317 | A1 * | 3/2005 | Chin et al. | 165/177 |
| 2006/0266501 | A1 * | 11/2006 | So et al. | 165/140 |
| 2009/0020278 | A1 * | 1/2009 | Zobel et al. | 165/177 |

OTHER PUBLICATIONS

Pettersen J. et al., "Development of Compact Heat Exchangers for CO2 Air-Conditioning Systems", International Journal of Refrigeration, May 1, 1998, pp. 180-193, vol. 21, No. 3, Elsevier, Paris, FR.

* cited by examiner

HEAT EXCHANGER

FIELD OF THE INVENTION

The application generally relates to heat exchangers in refrigeration, air conditioning and chilled water systems.

BACKGROUND OF THE INVENTION

There are numerous heat exchangers designed and manufactured using folded fins, and thin, non-round tubes which are then arranged or "stacked" and connected to manifolds (also called headers). These designs have been predominantly used for automotive water-to-air radiators, automotive condensers, truck air charge heat exchangers, automotive heater cores, industrial and truck air-to-oil coolers and more recently, automotive air-conditioning evaporators.

One such condenser is shown in U.S. Pat. No. 4,998,580. A pair of spaced headers has a plurality of tubes extending in hydraulic parallel communication between them and each tube defines a plurality of hydraulically parallel, fluid flow paths between the headers. Each of the fluid flow paths has a hydraulic diameter in the range of about 0.015 to about 0.04 inches. Preferably, each fluid flow path has an elongated crevice extending along its length to accumulate condensate and to assist in minimizing film thickness on heat exchange surfaces through the action of surface tension.

Another such condenser is disclosed in U.S. Pat. No. 6,223,556. The condenser includes two nonhorizontal headers, a plurality of tubes extending between the headers to establish a plurality of hydraulically parallel flow pads between the headers, and at least one partition in each of the headers for causing refrigerant to make at least two passes. An external receiver is also provided to hold refrigerant.

U.S. Pat. No. 5,193,613 discloses a heat exchanger having opposed parallel header tubes having circumferentially spaced grooves formed along the length thereof with inclined sides and a base on the external surface of the groove and spaced annular ribs on the inner surface opposite the grooves. Each groove has a transverse slot therein for receiving open ends of an elongated flat tube. The flat tubes are inserted into the header tubes in a manner which partially blocks the flow path inside the header tubes.

U.S. Pat. No. 5,372,188 discloses a heat exchanger for exchanging heat between an ambient heat exchange medium and a refrigerant that may be in a liquid or vapor phase. The same includes a pair of spaced headers with one of the headers having a refrigerant inlet and the other of the headers having a refrigerant outlet. A heat exchanger tube extends between the headers and is in fluid communication with each of the headers. The tube defines a plurality of hydraulically parallel refrigerant flow paths between the headers and each of the refrigerant flow paths has a hydraulic diameter in the range of about 0.015 to about 0.07 inches. The flow paths may be of varied configurations.

U.S. Pat. No. 4,998,580 discloses a condenser which transfers heat through small hydraulic flow paths. The condenser is for use in automotive applications in which horizontal tubes and small manifolds are used.

Attempts to apply the technology in HVAC&R (Heating, Ventilation, Air-Conditioning and Refrigeration) applications have achieved limited success. Success has been limited because many of the product features, design objectives, and operating issues of HVAC&R applications/equipment are significantly different and more diverse than automotive applications. For example, significant differences may exist in the operating conditions and environments, such as, but not limited to, cooling capacities, operating pressures, air flow rates, energy efficiency, mass flow rates, size of heat exchanger, height to width ratios, oil and refrigerant return, various refrigerants used, operating pressures and temperatures, etc.

Prior conventional heat exchangers, such as those configured for automotive applications which use thin flat tubes (for example, micro-channel tubes) and a brazed manifold structure exhibit deficiencies when provided for use in most HVAC&R applications.

Typical single and multi-pass heat exchanger designs exhibit high refrigerant pressure drops during operation, typically 5 psig or greater. These pressure drops are required to compensate for pressure drop losses in the manifolds or headers. While not an issue in compact automotive designs, where manifold pressure drop can be low, ignored or factored into the single operating design, this pressure drop is not acceptable in HVAC&R applications and can cause other system operating issues. These deficiencies are not apparent until actual field operation experience or test data is taken, and the dynamics and interaction of key operating conditions are better known.

Conventional construction of the manifold header is to use the smallest round material stock size possible (to form the manifolds) to match the tube width, for reasons of lower material cost and for manufacturing reasons associated with integral brazing of the tubes to the manifold. Thus, for a tube that is 1 inch wide, a 1 inch inside diameter manifold or header is typically used. While this particular size combination may generally be usable for automotive applications, allowing for good automated insertion of the tube into the header and stopping point for the tube, it is generally not suitable, and many times not appropriate, for most HVAC&R applications. That is, for broad-based use in HVAC&R applications, this or similarly sized manifold diameters, and more specifically, "useable cross sectional internal area" imposes significant operational limitations regarding the capacity and capacity range of the heat exchanger, and also induces major performance issues and losses due to pressure drop in the manifold or header, as well as refrigerant and oil entrapment in the manifold area. In condensers, this tube/manifold size combination corresponds to about a 5 percent to about a 20 percent operating capacity loss at various refrigerant flow conditions. In evaporators, this tube/manifold size combination results in a loss of operating capacity that can easily exceed 30 percent.

The pressure drop of refrigerant and fluids in the conventional manifolds or headers is one of several phenomena that can induce mal-distribution of refrigerant vapor entering the tubes. Mal-distribution may occur in heat exchangers functioning as condensers or evaporators. In condensers, an increase in the manifold pressure (or pressure drop) results in less refrigerant being provided to tubes positioned further from the inlet of the manifold or header. The effect can be worsened for multi-pass arrangements, depending upon the number of tubes, mass flow rate of refrigerant, or for other reasons. Imposing additional increase in pressure (or pressure drop) through the use of multi-passes can help compensate or partially correct the mal-distribution in condensers, but results in a significant additional refrigerant pressure drop and loss of heat transfer capacity of the heat exchanger. In evaporators, multi-pass arrangements can induce mal-distribution that increasingly occurs in each fluid flow pass through the tubes. In single pass evaporators, mal-distribution of refrigerant can be induced both in the entrance manifold or header and exiting manifold or header.

One way to avoid mal-distribution in condensers (and evaporators) has been to provide extremely low manifold header pressure losses as a ratio of tube pressure drop losses. In evaporators, the ratio of exit pressure drop due to the exiting manifold versus the pressure drop due to the tubes can be an important consideration. That is, the tubes near the connection may be subjected to a reduced pressure drop when compared to the pressure drop of the tubes positioned further away from the connection. For example, if the manifold has a one psi pressure drop over its length, and the tubes have a two psi pressure drop, the tubes closest to the exit connection will have more refrigerant flow than the tubes positioned further from the connection. Since the mass fluid flow rate is exponentially related to the induced pressure drop, the pressure drop over the length of the manifold may cause an imbalance of the amount of fluid being evaporated in each tube.

Conventional micro-channel tube heat exchangers have unpredictable performance due to internal manifold baffling. Tube pressure drop losses combined with manifold pressure drop losses in multi-pass designs require extremely complex calculations and analysis in order to predict both full load and part load performance of the heat exchanger. In addition, variations in the overall refrigerant charge in the refrigeration system, or "back up" of refrigerant in the condenser at full and/or partial load, can render all analysis and prediction, tenuous, if not unreliable. Thus, the refrigerant charge level can significantly affect the available condenser heat transfer (internal tube) surface and thus, refrigeration system capacity and energy use. In other words, the provision of a predetermined amount of refrigerant (versus "over-charging" or "under-charging" or loss of refrigerant over time) can adversely affect efficient operation of the heat exchanger, and the refrigerant system.

Because of the relatively small ratio of manifold or header cross sectional area to tube cross sectional area and manifold header to overall system capacity in the current state of the art heat exchangers, there is typically insufficient refrigerant holding charge in a conventional condenser having "micro-channel" tubes. Without the use of an additional component called a refrigerant receiver, the refrigeration system is thus said to be "critically charged". That is, a very small addition of refrigerant to the system may cause the condenser to "back up" with refrigerant inside the "micro-channel" tubes, thus reducing the amount of heat transfer surface, thereby increasing the condensing pressure (causing loss of system capacity and/or higher energy consumption). On the other hand, a loss of refrigerant or under-charge in a critically charged system can cause the evaporator to have insufficient refrigerant, resulting in reduced evaporator temperatures, which in turn results in loss of refrigeration capacity, and/or higher energy use, and/or potential freezing of water condensate on the air coil, (or water being cooled inside a refrigerant-to-water type evaporator). In some cases, the low evaporator temperatures result in system safety shut-down or possible evaporator rupture/failure. Thus, in the state of the art heat exchanger constructions or designs having "micro-channel" tubes, also referred to as "micro-channel" heat exchangers, users have discovered, when applied to typical HVAC&R equipment and system designs, there exists a narrow range of refrigerant volume (refrigerant charge) for a particular refrigerant system, in which if the refrigerant volume is outside of the range of refrigerant volume, that is, too much or too little refrigerant charge, can result in unexpected or adverse operations of the system, or possibly system failure.

SUMMARY OF THE INVENTION

One aspect of the invention is directed to a method of optimizing the performance of a heat exchanger. The heat exchanger has a first manifold, a second manifold and tubes extending therebetween. The tubes have at least one opening which extends through the entire length of the tubes. The method of optimizing includes the step of governing the pressure drop in the heat exchanger by selecting different size openings or configurations of the tubes depending upon the type of refrigerant used and the properties thereof.

The method may also include providing a liquid baffle in the second manifold to create a first chamber and a second chamber. The liquid baffle has an opening proximate thereto which extends from the first chamber to the second chamber. Optimizing the dimensions of the first manifold and second manifold is also disclosed, such that the ratio of manifold to tube size or manifold to tube opening cross sectional area yields low pressure drops and minimizes the effects of pressure drop in the manifold and tube combination. Additionally, the method may include optimizing the dimensions of the first manifold and the second manifold such that the ratio of the mass flow capacity of the first manifold and the second manifold to the tubes flow capacity is optimized such that the first manifold has minimal or negligible mal-distribution effect when providing refrigerant to the tubes, thereby improving the overall performance of the heat exchanger.

Accumulating condensed refrigerant liquid in the second manifold may also be provided to prevent the liquid refrigerant from backing up into the tubes. A baffle may be provided in the second manifold, allowing the second manifold to behave as a miniature receiver, thereby adding significant refrigerant charge holding capacity to the heat exchanger and allowing refrigerant charge level to fluctuate inside the second manifold. This additional refrigerant charge holding capacity increases the range or breadth of critical charge, whereby the increase or decrease of the refrigerant charge level, within a range, has substantially no effect on the performance of the heat exchanger. This additional refrigerant charge holding capacity also allows the excess refrigerant to continually accumulate in the second manifold, thereby providing additional heat transfer surface for condensing, whereby a refrigeration system to which the heat exchanger is attached attains higher energy efficiency at partially loaded conditions. The baffle blocks most of the second manifold except for the opening at the bottom of the second manifold, thereby creating two chambers in the second manifold, the first chamber serves as a refrigerant receiver and the second chamber serves as a transition chamber and passage to and from a refrigerant connection.

The method may also include the step of accumulating condensed refrigerant liquid, which is condensed in the tubes, in the second chamber. By so doing, the level of the refrigerant liquid in the second chamber will fluctuate, based on refrigerant use rate, due to overall refrigeration load. The second chamber will act as a receiver or holding tank to hold excess refrigerant when not in use by a refrigerant system which includes the heat exchanger.

The method also employs the use of vertical tubes, which are effected by gravity and capillary effects. This feature, combined with the manifold ratios and related dynamics, and combined with appropriate refrigerant pressure drops in the micro-channel tubes, provides consistent and predictable heat transfer, higher heat transfer rates (than configurations with smaller manifolds or tubes with lower pressure drops), Thus refrigerate flow distribution into the tubes, and better liquid removal from the tube to the receiver are improved.

Another aspect of the invention is directed to a heat exchanger which optimizes the heat exchanger capacity. The heat exchanger has a first manifold, a second manifold, and a liquid baffle is provided in the second manifold, the liquid baffle allowing the second manifold to behave as a miniature receiver and orifice, allowing excess liquid refrigerant to continually accumulate in the second manifold. Vertically oriented tubes extend in fluid communication between the first manifold and the second manifold. A ratio of the tube width to the effective cross sectional diameter of the first manifold and the second manifold (an "effective cross sectional ratio") is less than 1.20. The heat exchanger is capable of operating in either a condenser mode or an evaporator mode with virtually no adverse effect on system performance.

The heat exchanger may also have an inlet provided in the first manifold and an outlet provided in the second manifold. The second manifold has a liquid baffle to create a first chamber and a second chamber. An opening is provided proximate the liquid baffle, with the opening extending from the first chamber to the second chamber. The baffle and opening are dimensioned to allow only refrigerant liquid to pass through the opening, whereby any gas accumulation in the second chamber is trapped and eventually condensed, and not allowed to pass through the opening. The baffle allows the second manifold to behave as a miniature receiver, allowing excess refrigerant to continually accumulate in the second manifold. This accumulation of refrigerant provides additional heat transfer surface for condensing, whereby a refrigeration system to which the heat exchanger is attached attains higher energy efficiency at partially loaded conditions. The baffle also blocks most of the second manifold except the narrow opening at the bottom of the second manifold, thereby creating two chambers in the second manifold, the first chamber serves as a refrigerant receiver and the second chamber serves as a transition chamber and passage to and from a refrigerant connection. The baffle opening can be sized to induce a small pressure drop (i.e. 0.25 psig), up to a high pressure drop (15 psig), to counteract any effects of external refrigerant piping, to assure residual gas condensing in the receiver, and in evaporators, serve as an entrance orifice for better refrigerant acceleration and liquid/gas mixing.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE EMBODIMENT SHOWN

Figure 1:
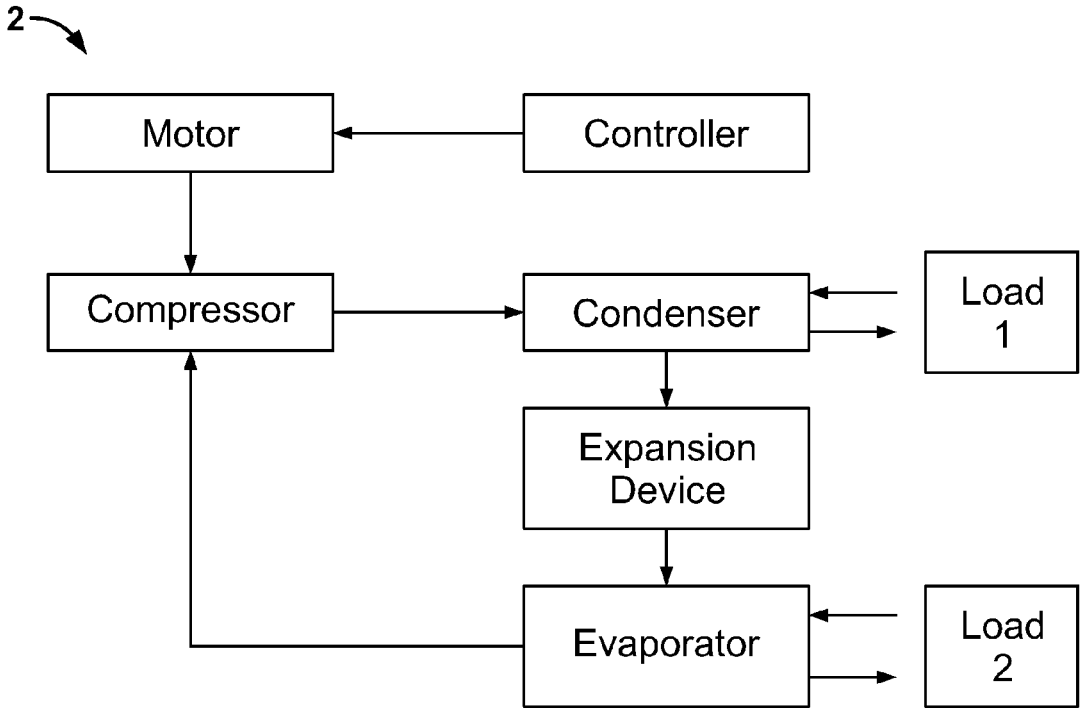
FIG. 1 is a diagrammatic view of an exemplary vapor compression system in which a heat exchanger of the present invention is used.
Figure 2:
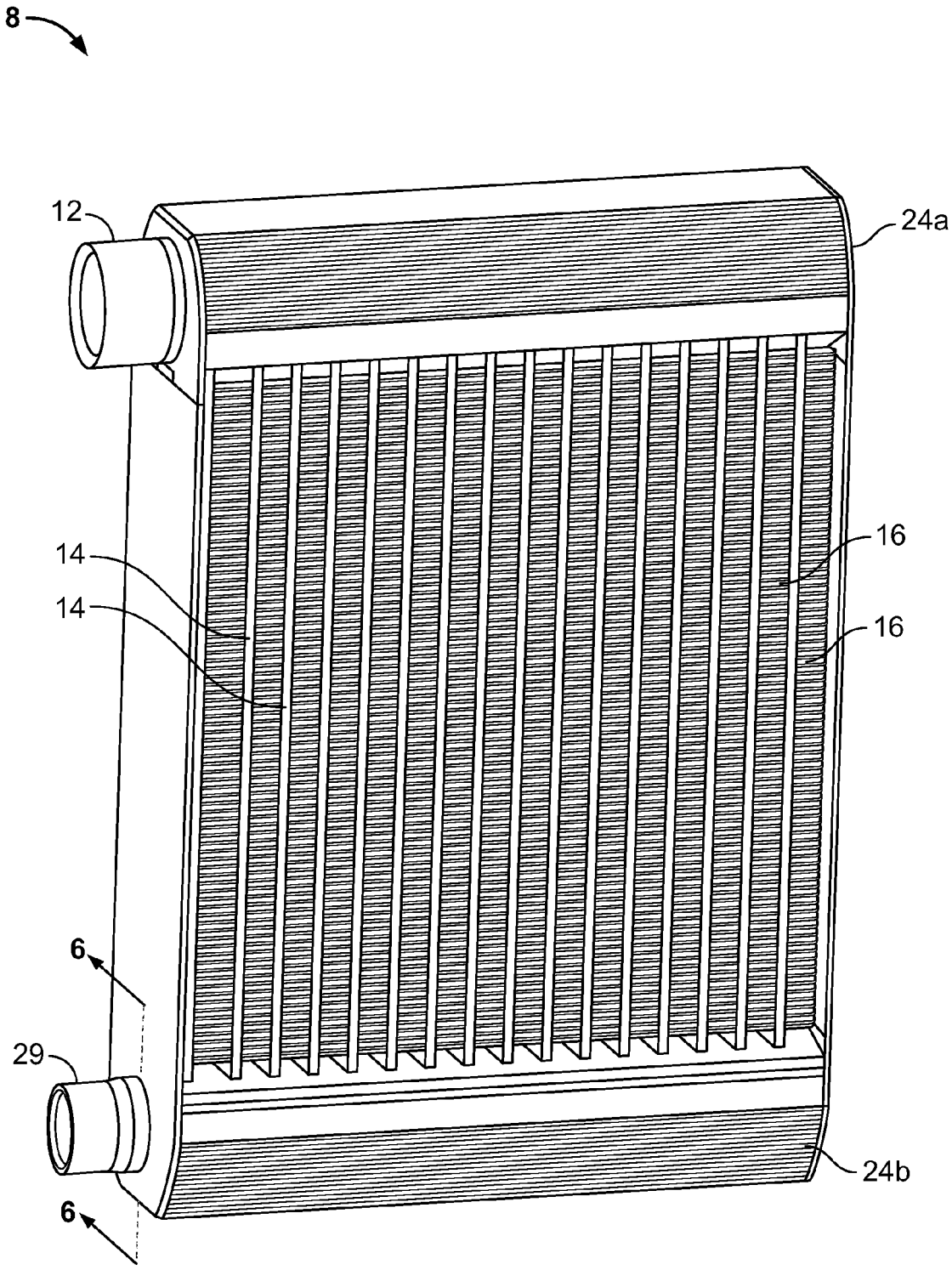
FIG. 2 is a perspective view of an exemplary heat exchanger of FIG. 1.
Figure 3:
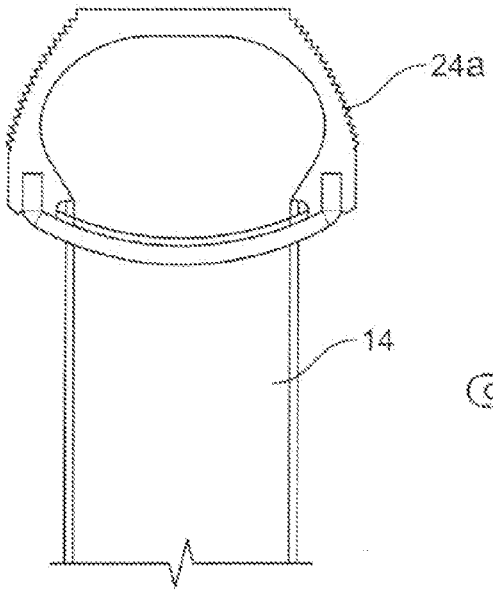
FIG. 3 is a cross-sectional view of a manifold with a tube positioned therein of an exemplary heat exchanger of FIG. 2.

Referring to FIGS. 1 and 2, a vapor compression system 2, such as a refrigeration system, is illustrated in which compressed refrigerant vapor is conveyed to an inlet 12 of a heat exchanger 8, such as an aluminum heat exchanger of brazed construction, also referred to as an air cooled condenser. Other suitable materials may be used to construct the heat exchanger. The inlet 12 is also known as the "hot side" or "pressure side" of the refrigeration system. The condenser typically uses air (provided at a temperature that is less than the refrigerant condensing temperature) flowing between and/or across fins 16 positioned between tubes 14 to cool and condense the refrigerant contained inside the tubes to a liquid state. The liquid is then conveyed to a control valve 18 which regulates the flow of refrigerant to an evaporator (also known as the "cold side" or "low pressure side") of the refrigeration system, whereby the refrigerant pressure is reduced across the control valve 18 and conveyed to the evaporator to provide a reduced temperature for cooling air or fluid, also referred to as a working fluid. In an evaporator version of a brazed heat exchanger 8, the refrigerant enters the evaporator in a predominantly liquid state and is evaporated inside the heat exchanger 8 as heat is transferred from the working fluid to the refrigerant. The vapor refrigerant exits the evaporator and is delivered to a compressor 22 which then compresses the vapor to an increased pressure level to be conveyed to the condenser, thus completing the refrigeration cycle.

Figure 4A:
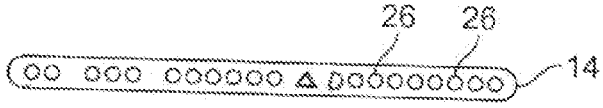
FIG. 4A is a cross-sectional view of a tube of the heat exchanger showing openings which extend through the length of the tube.
Figure 4:
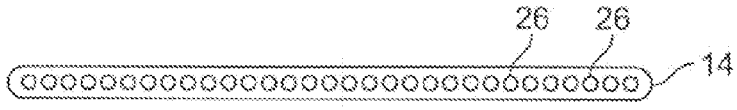
FIG. 4 is a cross-sectional view of a tube of the heat exchanger showing openings which extend through the length of the tube.
Figure 5:
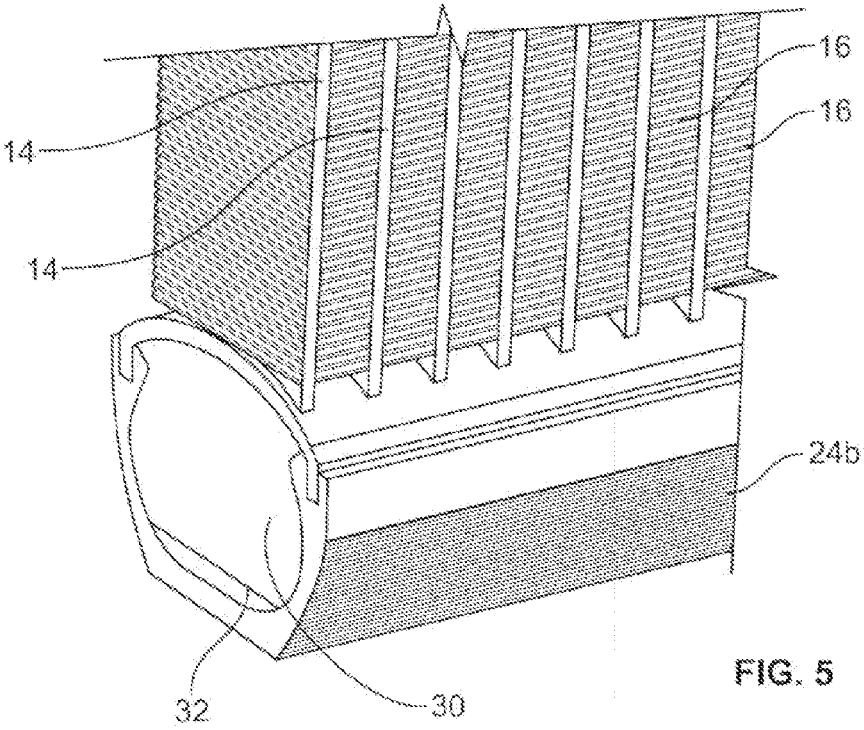
FIG. 5 is a cross-sectional view of a manifold showing a liquid baffle and opening provided therein.

In one embodiment of the present disclosure, such as shown in FIGS. 2-6, the heat exchanger 8 may have tubes 14, sometimes referred to as "micro-channel" tubes, and manifolds or headers 24 connected to the tubes 14, such as by brazing. This type of heat exchanger 8 is sometime referred to as a "micro-channel" heat exchanger. In an exemplary embodiment, such as shown in FIG. 4, each tube 14 may have a plurality of ports or openings 26 formed therein to convey fluid between opposed manifolds or headers 24. As further shown in FIG. 4, the openings 26 may be substantially evenly spaced in a single row and may be of uniform size, and the tube 14 that contains the openings may be substantially flat.

As shown in FIG. 4, for example, the tubes 14 may have exterior transverse dimensions of about 0.020 inch in thickness by about 4 inch in width. Referring again to FIGS. 2-6, fins 16, such as folded fins (for example, rippled or louvered) may be provided which extend between the tubes 14. In one embodiment the fins 16 may be integrally brazed between the tubes 14, and in a further embodiment, the tube ends may be brazed into a manifold or header 24, at each end of the arrangement of tubes 14. The manifolds or headers 24 may be configured to allow refrigerant or fluid to flow into one or more tubes 14 positioned in parallel between the manifolds 24. In an alternate embodiment, baffles or partitions (not shown) may be positioned in at least one of the manifolds 24, defining multi-pass configurations whereby fluid entering a first header 24*a* may be directed to selectably flow from the first header through a predetermined number of tubes 14 to a second header 24*b*, returning through yet another predetermined number of tubes 14 to the first header 24*a*, the flow pattern between the headers 24 repeating, until the fluid has been directed through all of the tubes 14 between the first and second manifolds 24*a*, 24*b* prior to exiting the heat exchanger 8. Multi-pass systems may include any of 2, 3, 4, 5, 6 or more refrigerant/fluid passes through the arrangement of tubes 14. For example, in an exemplary embodiment of a heat exchanger 8 having a grouping or arrangement of 30 tubes 14 and situated partitions in the manifolds, the first ten of the grouping of tubes could define a first fluid pass, the second ten of the grouping of tubes could define a second pass and the remaining ten of the grouping of tubes could define a third pass.

In other embodiments, the openings 26 may be unevenly spaced in one or more rows, including a random arrangement of openings, with the openings 26 being circular or non-circular and with openings 26 that may vary in size and/or shape along the length of the tube 14, such as shown in FIG. 4A. In a further embodiment, the openings 26 may be formed in different sizes and shapes within the same tube 14. In yet further embodiments, the cross sectional area of one or more of the tubes 14 and/or openings 26 may vary along the length of the tubes 14. Further, the tube 14 is not constrained to a substantially flat construction. Finally, the relative size of the openings 26 are not limited as shown in FIG. 4, that is, the cross-sectional area of the openings 26 may range from less than the equivalent cross-sectional area of a circular opening having a diameter of 0.001 inches to greater than the equivalent cross-sectional area of a circular opening having a diameter of at least .090 inches or more, depending upon application and the desired pressures, fluid flow rates, working fluids and other operating parameters or conditions.

Referring to FIGS. 1 through 6, the heat exchanger 8 is configured for use with a refrigeration system. As discussed, the heat exchanger 8 has an inlet 12, upper manifold header 24*a*, tubes 14, such as "micro-channel tubes", fins 16, a lower manifold or header/receiver 24*b*, an outlet 29, liquid baffle 30, and an opening or orifice 32 created by the baffle between the liquid baffle 30 and the lower manifold or header/receiver 24*b*.

The heat exchanger 8 can be configured to operate properly at low refrigerant pressure drops or high pressure drops, depending upon the tube opening 26 sizes selected in the tubes 14. The heat exchanger 8 causes only a low pressure drop in the upper header 24*a*. The amount of pressure drop can be modified to optimize performance. Pressure drop selection may be accomplished by selecting one of several micro-channel tubes 14 with different opening 26 sizes and configurations. These tube options and selections can take in account the device response to gravity, or non-response to gravity, or response due to capillary effects, depending upon the refrigerant type used and its surface tension which holds refrigerant inside the tube ports.

The manifold headers 24 are enlarged to a ratio of manifold 24 to tube 14 size and/or manifold 24 to tube opening 26 cross sectional area, greater than current state of the art, a larger ratio demonstrated to yield extremely low pressure drops and effects of pressure drop in the manifold and tube combination.

When used as a condenser and/or evaporator, the manifold headers 24 are enlarged and applied to a ratio related to mass flow capacity of header 24 to the tube 14 flow capacity, and ratio of manifold or header 24 to tube pressure drop, such that the manifold or header 24 has minimal or negligible maldistribution effect in feeding refrigerant to the tubes 14, and thus improving overall heat exchanger performance. Further, when used as a condenser or evaporator, the tubes 14 may be configured as single pass, vertical, such that refrigerant flow is influenced (or not) by gravity and/or capillary effects within the tubes, as previously stated. Thus, when used as a condenser, condensed refrigerant liquid can accumulate in the lower manifold header 24*b*, and not back up into the tubes 14.

There is no internal baffling to redirect refrigerant into multi-passes, and thus unpredictability is generally eliminated or minimized, regardless of heat exchanger size or configuration, as was a major issue with the prior art. The limits or effects of the upper manifold header 24*a*, tubes 14 and lower manifold header 24*b* govern the predictability of the device and provides for improved ability to control and thermodynamically model the end result. Furthermore, substantial non-blockage of the manifold and positioning of the tubes away from the center of the manifold reduced compressor oil entrapment and oil return back to the compressor.

Figure 7:
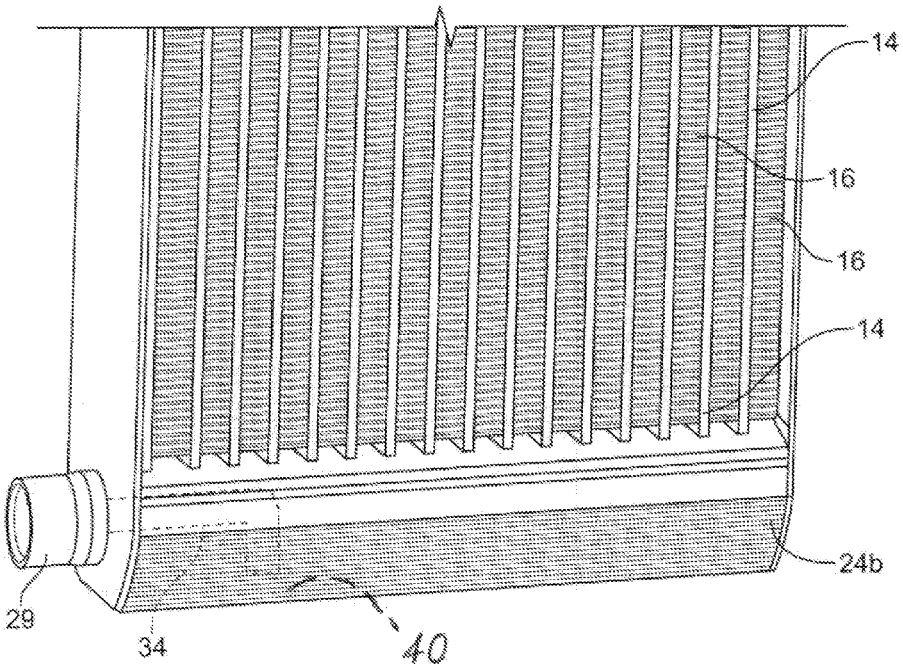
FIG. 7 is a cross-sectional view, similar to that of FIG. 6, showing an alternate embodiment in which a tube baffle is positioned in the manifold.

When used as a condenser, with the tubes 14 oriented substantially vertically, and the upper manifold header 24*a* sized to a ratio larger than previous industry practice, and/or to a ratio capacity of the tubes 14 to upper manifold header 24*a* larger than previous industry practice, the lower manifold header 24*b* can be configured to behave as a miniature receiver by insertion of a baffle 34, such as a tube having a J formed tube profile (shown in FIG. 7) into the lower manifold header 24*b* at a specific location and method. The use of the lower manifold header 24*b* as a miniature receiver adds significant refrigerant charge holding capacity and allows the refrigerant charge level to fluctuate inside the lower manifold header 24*b* due to the baffle or tube 34 at the liquid exit area, thereby increasing the range or breadth of critical charge, whereby refrigerant charge level (excess charge or loss of charge within a range) would have virtually no effect on system performance. Further, by allowing excess refrigerant to continually accumulate in the lower manifold header 24*b*, additional heat transfer surface is available for condensing and the refrigeration system 2 attains higher energy efficiency at part-load conditions.

Figure 6:
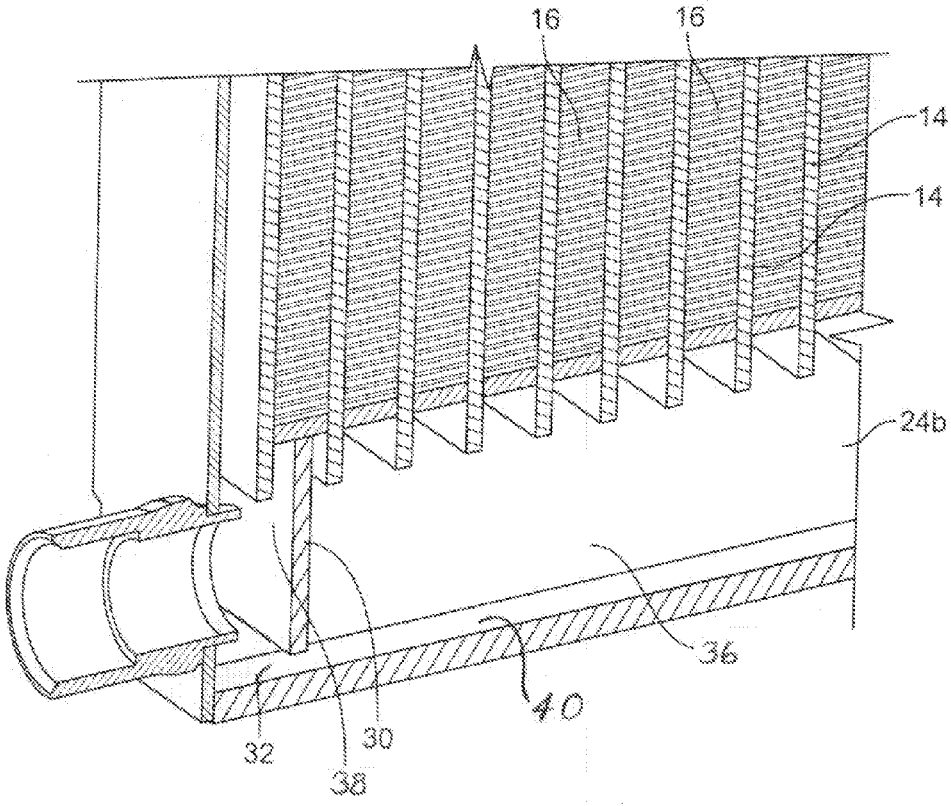
FIG. 6 is a cross-sectional view of the manifold, taken along line 6-6 of FIG. 2, showing a first chamber and a second chamber.

Referring to FIG. 6, the liquid baffle 30 in the lower manifold 24*b* is typically located in close proximity (but not necessarily), to the refrigeration connection such that two chambers 36, 38 are created, the first chamber 36 to serve as a refrigerant receiver (on left) and the second chamber 38 (on right) to serve as a transition chamber and passage to and from the refrigerant connection. The liquid baffle 30 is typically located either before the first vertical tube or after the first tube, depending upon the mass flow rate and minimal pressure drop effect of the transition chamber. The function of the liquid baffle 30 is to provide almost complete blockage of the lower manifold 24*b*, such that the baffle 30 blocks most of the manifold 24*b* except a narrow location at the bottom of the manifold. This narrow opening is referred to as the orifice 32.

When the heat exchanger is used as a condenser, the liquid baffle 30 functions such that liquid refrigerant, having been condensed in the vertical tubes 14 and upon exiting the tubes accumulates in the receiver chamber section 36 of the manifold 24*b*. The liquid level in this receiver chamber 36 will fluctuate, based on refrigerant use rate, due to overall refrigeration load. The liquid levels will increase when the refrigeration system load is less than maximum and not requiring as much refrigerant, and will decrease with increased refrigeration load. The liquid levels will also vary based on overall refrigerant charge level for the system. Thus, the receiver chamber 36 acts as a receiver or holding tank to hold excess refrigerant when not in use by the system 2 at various times.

Refrigerant in the receiver chamber 36 is also flowing continuously out of chamber 36, through the orifice 32, and into the second transition chamber 38. Due to the location of the orifice 32 in the lower portion of the baffle 30 in the manifold 24*b*, only refrigerant liquid may pass through the orifice 32, and any gas accumulation in the receiver chamber 36 is trapped and not allowed to pass. The fluid trap serves to prevent gas from leaving the condenser, which is undesirable and could cause system operating problems.

A second feature of the orifice 32 is that its cross sectional area (orifice size) is determined based the maximum mass flow rate of the system. The orifice size is also selected based on a desired pressure drop across the orifice 32. The orifice size can be selected to have negligible or small pressure drop (i.e. 0.25 psig), up to a high pressure drop (15 psig), to counteract any effects of external refrigerant piping and to assure residual gas condensing in the receiver. In evaporators, the opening can be sized serve as an entrance orifice for better refrigerant acceleration and liquid/gas mixing.

When the heat exchanger 8 is used as an evaporator, where liquid/gas refrigerant mixture enters the heat exchanger 8 via the lower connection and manifold 24*b*, prior to entering the vertical tubes 14. In an exemplary embodiment, the liquid baffle 30 and orifice 32 has little or no effect on the system 2 operation, based on proper orifice sizing and pressure drop effects. In such an embodiment, the heat exchanger allows controlled refrigerant flow in both directions such that the liquid baffle 30 and its orifice 32 can work in both condensing and evaporator modes required for heat pump systems.

In a further embodiment, by specific insertion of the liquid baffle 30 or J tube 34 into the outlet area of the lower manifold 24*b*, only refrigerant liquid located near the at lowest point in the lower header 24*b* is allowed to flow under the baffle 30 (or up into the tube 34), creating a continuous liquid seal, thereby blocking any unwanted gas which might otherwise flow into the liquid return line to the system 2. This combination baffle 30 and resulting orifice 32 essentially forms the function of a "P" trap to assure only liquid flow, and no gas flow into the liquid line. The baffle/orifice 30, 32 combination also allows the refrigerant level in the lower manifold header 24*b* to fluctuate, rise and fall, with system operation or refrigerant charge level. This feature accommodates typical changes in mass flow rate during system operation and changing refrigeration load, or, loss of refrigerant, or, over-charge of refrigerant in the system. The baffle/orifice 30, 32 or tube 24 arrangement also eliminates an alternative use of "P" traps in the refrigeration piping, and reduces or eliminates the use or need of an external receiver tank on or below the heat exchanger 8, or eliminates or reduces the size of a receiver (refrigerant storage tank) that might be employed in some systems. Thus, the baffle 30 or inserted tube 34 converts the lower manifold header 24*b* into a miniature receiver, while allowing refrigerant condensing and subsequent refrigerant sub-cooling to occur at lower pressures and temperatures within the tubes 14 and lower header 24*b*. This multi-benefit, multi-feature aspect of the lower manifold header 24*b*, combined with the low pressure drop characteristics of the upper manifold header 24*a* is believed to be novel and unique.

In the illustrations the orifice 32 is shown in the lowest part or lowest portion 40 of the lower header 24*b*, when the heat exchanger 8 is vertical. In another variation of this invention is that the orifice 32 can be positioned and oriented inside the manifold 24*b* when the heat exchanger 8 is operated at other orientations, i.e., 30 degree angle, 45 degree angle to horizontal flat; the orifice 32 can be positioned at the lowest vertical point inside perimeter of the lower manifold 24*b*, regardless of heat exchanger orientation. If a J tube 34 is used, the tube 34 can be repositioned or rotated such that it pulls or draws liquid refrigerant from the lowest vertical portion 40 of the lower manifold header 24*b* to achieve the same results as the baffle 30.

Industry practices in conventional automotive type systems have a typical 1:1 to 1:1.15 ratio of tube width to manifold internal diameter. This allows the tube insertion into the manifold and use of the interior of the manifold as a tube stop. In addition, there is typically a blockage of 40 percent to 50 percent of the functional cross section area of the manifold, thereby making the "effective cross sectional ratio" (tube width to effective manifold cross sectional diameter) to be in a typical range of 1.298 to 1.82 ratio of tube width with respect to the effective manifold diameter.

In this disclosure, the effective cross sectional ratio is less than 1.20 and typically somewhere between about 0.90 to about 1.18, but could be applied effectively below 1.18 effective cross sectional ratio, and effectively applied below 0.90 effective cross sectional ratio. (Generally, the lower the ratio, the better the positive effects). Stated in another way for comparison, the effective cross sectional area of the manifold header in this disclosure is somewhere between about 1.66 to about 3.05 times larger than typical prior industry practice. The significance of these ratios is not apparent until various heat exchanger sizes and typical application of HVAC heat exchangers are tested and modeled. Depending upon the application and mass flow rate in the manifold headers, the heat exchanger of the present disclosure has a significantly lower pressure drop in the manifold and the port size or port geometries and pressure drops of the tubes have less effect on mal-distribution, and thus, reduces the effect of the manifold on the overall performance of the heat exchanger, and allows for a wider variety of tube port diameters and designs. Furthermore, as the manifold length is increased, the importance of this inter-relation with the tubes increases, and in thus, the heat exchanger size, efficiency and capacity can be increased.

Depending upon the geometries and (smooth or non-smooth, i.e., intermittent tube interruptions or protrusions) interior of the manifold, for a prior art condenser, a typical rule of range for refrigerant gas flow in a manifold is a maximum 12 to 22 tons per square inch (36 to 66 lbs per minute mass flow per square inch) of cross section area for R22 at 110 degrees F. condensing temperature. For a prior art evaporator, this typical range for refrigerant flow in a manifold is a maximum of 10 to 15 tons per square inch (30 to 45 lbs per minute mass flow rate per square inch) of cross sectional area for R22 at 35 degrees F. evaporating temperature. This maximum mass flow rate range(s) is higher for high pressure refrigerants such as R410a and much lower for low pressure which would involve operating refrigerants such as R134a, and directly related to gas density at the operating pressures of any refrigerant. Typical industry practice, within the above-referenced guidelines, a 1.15 inch internal diameter manifold with 50 percent typical blockage would have a maximum effective capacity of 6 to 10 tons using R22 as a condenser, and 5 to 7.5 tons using R22 as an evaporator. In contrast, the heat exchanger of the present disclosure would have a maximum effective capacity of somewhere between about 16 to about 28 tons when using R22 as a condenser and somewhere between about 10 to about 20 tons when using R22 as an evaporator, depending upon manifold length and operating design conditions. Since pressure drop is exponential with regards to mass flow rate, this mass flow ratio of somewhere between about 1.66 to about 2.0 is somewhere between about 2.0 to about 2.66 times higher than previous designs. The heat exchanger of the present disclosure translates into 2.7 times to 7.1 times lower manifold pressure drop, depending upon the internal manifold geometries and desired mass flow rates. This lower pressure drop affects how tubes 14 are evenly fed refrigerant sequentially, in line, as the refrigerant flows through the manifold 24 (between 24*a* and 24*b*) and reduces the need to insert tubes having higher pressure drops to counteract the effects of the manifold 24*a* pressure drop. Thus, the upper manifold pressure drop of the heat exchanger of the present disclosure, as related to the tubes, mass flow rates, operating conditions and design conditions, yields new performance characteristics for this type of heat exchanger and allows for a much broader range of HVAC&R applications.

Although other ratios can be used to define the novelty of the heat exchanger 8 of the present disclosure, the one(s) chosen are believed to best reflect the overall mechanical structures, and defined differences with industry practices, without integrating the complex effects of variables such as mass flow rate, refrigerant CFM, tube protrusion effects into the manifold, gas distribution, capillary effects within tubes, heat exchanger tube orientation and other system operating variables.

The effects of refrigerant mal-distribution in a condenser, induced by the upper header 24*a* or multi-pass configuration, can reduce the heat exchanger capacity and reduce the overall system energy efficiency. By reducing the amount of lower manifold pressure drop, as well as associated lower pressure drop ratios in regards to the mass flow rate capacity of the tubes 14 and number of tubes 14 required, the heat exchanger 8 of the present disclosure minimizes the effect of the manifold header 24 on system 2 associated with reductions of heat exchanger 8 performance.

In an evaporator configuration, whereby the refrigerant enters the lower manifold 24*b* of the heat exchanger 8, flows and evaporate up the tubes 14 prior to entering the upper manifold header 24*a* (opposite flow direction of the refrigerant as compared to the condenser), the pressure drops induced by the tubes 14 and upper manifold 24*a* are more significant in causing mal-distribution of refrigerant entering the tubes 14 and effecting the evaporating temperature in the tubes 14, thus creating greater problems and loss of heat exchanger capacity in several ways. System capacity loss and/or proper evaporator operating temperature is a critical design issue(s), and the tubes 14 must also have relatively low pressure drop of typically somewhere between about 0.1 psi to about 5 psi, depending upon the refrigerant and operating conditions. Thus the upper manifold header 24*a* effects mal-distribution in the tubes 14 and evaporation temperatures and the heat exchanger 8 of the present invention, related to the tube to manifold ratios widens the application range for evaporators.

In addition, in an evaporator configuration, the lower manifold 24*b* has an even greater effect of mal-distribution or overfeed of refrigerant in one tube 14 or groups of tubes 14. An overfeed factor of somewhere between about 1.05 to about 1.10 in one or multiple tubes can have a devastating loss of heat exchanger capacity due to incomplete boiling of the refrigerant in those tubes and the limited heat transfer capacity of each tube. Since an evaporator is typically controlled by a thermal expansion valve that adjusts refrigerant flow to the heat exchanger based on outlet superheated gas temperature, when mal-distribution occurs (and overfeed of one or more tubes occurs), the thermal expansion valve will measure a lower superheated gas temperature (due to overfed refrigerant evaporating in the upper manifold header, thereby reducing superheat temperatures leaving the heat exchanger). When a lower than set point superheat temperature is measured by the thermal expansion valve, the device controls are configured to close the valve until the superheat temperature is achieved. This valve closure essentially reduces the heat transfer rate (capacity) of the evaporator heat exchanger. Thus, mal-distribution (overfeed) of refrigerant to one or more tubes will induce the valve to close, thereby reducing the heat exchanger performance. The lower manifold (5) and its ratios can play a significant role in reducing or eliminating the refrigerant mal-distribution.

When used in a heat pump application, whereby the heat exchanger 8 operates in condenser mode, and at other times in evaporator mode, this invention accommodates all the above issues, except for mal-distribution of refrigerant in the lower header in evaporator mode. In addition, the lower manifold's liquid baffle 30 and receiver feature, which functions in the condenser mode, can be operated in the evaporator mode as well. This is a very unique and novel feature; that is, for a built-in receiver to be capable of reverse cycling with virtually no adverse effect on system performance, while simultaneously not requiring bypass valves (formerly need to circumvent or to "pipe" around the receiver).

This invention described herein and shown in FIGS. 1-6, reveals new and existing components, in combination, working in conjunction with refrigeration systems to solve issues in the use of brazed micro-channel heat exchangers in HVAC&R applications. One embodiment is directed to a brazed heat exchanger configuration for air (or vapor) to refrigerant applications such that i) the refrigerant tubes may be configured for a single pass, substantially vertical orientation; ii) the refrigerant tubes can have various internal port sizes; iii) refrigerant manifold headers are enlarged and unrestricted to obtain low entrance pressure drop and other characteristics in relation to the tubes, iv) the enlarged manifold headers providing refrigerant holding capacity, and v) a baffle/orifice (or tube) can be located near the refrigerant outlet to retain a sufficient amount of liquid refrigerant so as to provide a "back up" preventing gas from entering the leaving refrigerant connection and to induce other desirable operating characteristics. In alternate embodiments, different combinations of the features i) through v) may be employed. Regardless of the particular embodiment, the invention is intended to achieve new results as a refrigeration condenser and/or evaporator, and/or heat pump heat exchanger.

It may be desirable to provide a lower pressure drop manifold header in relationship to mass flow rate of the application, in conjunction with nominal pressure drops induced by the tubes, in conjunction with liquid refrigerant holding capacity, combined with a baffle/orifice (or tube) to provide substantially only liquid flow from the condenser, and optional back-pressure at the condenser outlet. This overall device characteristic may be applied to a broad range application of heat exchangers in HVAC&R systems, such as brazed aluminum heat exchangers, and can be used over an extremely wide range of design and real world operating conditions and capable of being used with various refrigerants, such as previously mentioned, including applications as a condenser and/or evaporator, with heat pump applications where the heat exchanger operates in condenser mode (for heating), and then in evaporator mode (for cooling).

The prior art focused on smaller automotive designs, where pressure drops in manifolds were tolerated and tube pressure drops were compensated by multi-passing thru the heat exchanger. These automotive designs would not have discovered nor needed a more significant relationship with the manifold and tube pressure drop interactions, until larger heat exchangers 2× to 30× larger in both physical size and refrigerant mass flow rate, were needed for HVAC/R applications.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claim.

The invention claimed is:

1. A heat exchanger which optimizes the heat exchanger capacity, the heat exchanger comprising:

a first manifold;

a second manifold;

a liquid baffle is provided in the second manifold, the liquid baffle allowing the second manifold to behave as a receiver and orifice, allowing excess liquid refrigerant to continually accumulate in the second manifold;

vertically oriented tubes extending in fluid communication between the first manifold and the second manifold;

a ratio of the tube width to the effective cross sectional diameter of the first manifold and the second manifold (an "effective cross sectional ratio") is less than 1.20;

wherein the heat exchanger is capable of operating in either a condenser mode or an evaporator mode with virtually no adverse effect on system performance;

wherein the heat exchanger has an inlet provided in the first manifold and an outlet provided in the second manifold, the second manifold having the liquid baffle to create a first chamber and a second chamber, and an opening proximate the liquid baffle, the opening extending from the first chamber to the second chamber;

wherein the liquid baffle and orifice opening are configured and disposed to allow refrigerant liquid to pass through the opening, whereby gas accumulated in the second chamber is substantially trapped and prevented from passing through the opening.

2. The heat exchanger of claim 1 wherein multiple openings are provided in each tube, the openings extend the length of the tubes and are substantially evenly spaced in a single row and are of uniform size.

3. The heat exchanger of claim 1 wherein multiple openings are provided in each tube, the openings extend the length of the tubes and are unevenly spaced in a one or more rows and are of different size or shape.

4. A heat exchanger which optimizes the heat exchanger capacity, the heat exchanger comprising:

a first manifold;

a second manifold;

a liquid baffle is provided in the second manifold, the liquid baffle allowing the second manifold to behave as a receiver and orifice, allowing excess liquid refrigerant to continually accumulate in the second manifold;

vertically oriented tubes extending in fluid communication between the first manifold and the second manifold;

a ratio of the tube width to the effective cross sectional diameter of the first manifold and the second manifold (an "effective cross sectional ratio") is less than 1.20;

wherein the heat exchanger is capable of operating in either a condenser mode or an evaporator mode with virtually no adverse effect on system performance;

wherein the receiver and orifice, allowing excess refrigerant to continually accumulate in the second manifold, thereby providing additional heat transfer surface for condensing, whereby a refrigeration system to which the heat exchanger is attached achieves increased energy efficiency at partially loaded conditions.

5. The heat exchanger of claim 4 wherein the refrigerant is drawn into the tubes from a lowest vertical portion of the second manifold.

6. The heat exchanger of claim 1 wherein the liquid baffle in the second manifold separates the second manifold except a narrow opening at the bottom of the second manifold, thereby creating two chambers in the second manifold, the first chamber serves as a refrigerant receiver and the second chamber serves as a transition chamber and passage to and from a refrigerant connection.

7. The heat exchanger of claim 1 wherein the tubes extend between the first manifold and the second manifold in a vertical orientation, such that refrigerant flow is influenced by gravity or capillary effects within the tubes.

8. The heat exchanger of claim 1, wherein the heat exchanger is capable of operating in either the condenser mode or the evaporator mode with virtually no adverse effect on system performance, while simultaneously not requiring bypass valves to circumvent the receiver.

9. The heat exchanger of claim 1, wherein the effective cross sectional ratio is between about 0.90 to about 1.18.

10. The heat exchanger of claim 1, wherein the effective cross sectional ratio is less than 1.18.

11. The heat exchanger of claim 1, wherein the effective cross sectional ratio is less than 0.90.

* * * * *